US005816709A

United States Patent [19]

Demus

[11] Patent Number: 5,816,709

[45] Date of Patent: Oct. 6, 1998

[54] LEAK-PROOF PERSONAL TRAVEL BAG

[76] Inventor: Andrew Demus, 18638 Rocoso Pl., Tarzana, Calif. 91356

[21] Appl. No.: 947,167

[22] Filed: Oct. 8, 1997

[51] Int. Cl.[6] ..... B65D 33/24; B65D 81/26

[52] U.S. Cl. ..... 383/61; 206/204; 206/581; 383/63; 383/82; 383/85; 383/88

[58] Field of Search ..... 206/204, 581; 383/59, 61, 63, 65, 66, 82, 85, 86, 88, 89

[56] References Cited

U.S. PATENT DOCUMENTS

| | | | |
|---|---|---|---|
| 3,446,420 | 5/1969 | Rinecker . | |
| 3,585,275 | 6/1971 | Gillemot | 383/61 X |
| 3,655,118 | 4/1972 | Rinecker . | |
| 3,998,304 | 12/1976 | Edgerton, Jr. et al. . | |
| 4,153,090 | 5/1979 | Rifkin . | |
| 4,184,596 | 1/1980 | Avery | 383/89 X |
| 4,241,865 | 12/1980 | Ferrell . | |
| 4,262,801 | 4/1981 | Avery | 383/82 X |
| 4,318,506 | 3/1982 | Hirsch . | |
| 4,421,150 | 12/1983 | Masters . | |
| 4,638,912 | 1/1987 | Graf . | |
| 4,706,297 | 11/1987 | Ausnit . | |
| 4,824,261 | 4/1989 | Provost . | |
| 4,902,141 | 2/1990 | Linnewiel . | |
| 5,048,692 | 9/1991 | Handler et al. . | |
| 5,244,136 | 9/1993 | Collaso | 383/89 X |

FOREIGN PATENT DOCUMENTS

| | | | |
|---|---|---|---|
| 2654637 | 6/1978 | Germany | 383/61 |

*Primary Examiner*—Bryon P. Gehman
*Attorney, Agent, or Firm*—Larson & Taylor

[57] ABSTRACT

A leak-proof travel bag for carrying items containing liquids, such as personal toiletry products, is provided with a ziplock seal towards the top of the bag. The bag also has one fastener for retaining the top of the bag in a once folded position, and a second fastener attached to a flap for retaining the bag in a twice folded position. Optionally, located inside the bag is an absorbing membrane that prevents liquids that might have become free from their original containers during travel from reaching the two folds that protect the ziplock seal.

10 Claims, 6 Drawing Sheets

LEAK-PROOF PERSONAL TRAVEL BAG

BACKGROUND OF THE INVENTION

1. Field of the Invention

During travel, personal toiletry items are often carried in the same suitcase that carries clothing and other valuables. Frequently, such personal toiletry items are disposed within breakable containers or containers that have easily openable tops. As a result, these personal toiletry items sometimes become broken or uncapped, and spill liquids over other contents within one's suitcase. Such spills often destroy valuable items, necessitate expensive or time-consuming clean-up, or make for an embarrassing situation if the spill goes previously unnoticed.

The invention relates to a leak-proof travel bag, and in particular, a leak-proof travel bag having a leak-proof resealable opening and an absorbing material disposed within the bag for retaining free liquids (or flowable solids) that may spill during travelling.

2. The Prior Art

There are numerous resealable bags that have a press-and-fit (ziplock) sealing closure. Some of these resealable bags augment sealing by folding part of the bag upon itself so that the fold assists in preventing liquids from entering or leaving the container. However, these sealing closures are not always leak-proof, and therefore any liquid that becomes free to move about within the bag can still escape.

None of the prior art containers addresses the specific need of having to prevent free liquid from a spill for example from escaping the container, while also minimizing the spread of the spill within the resealable container itself. Accordingly, the need exists to overcome these problems of the prior art.

SUMMARY OF THE INVENTION

In accordance with the invention, a leak-proof personal travel bag for toiletries is provided that is made of leak-proof and puncture-proof vinyl material. The bag has an absorbing material disposed within for minimizing the spread of an uncontained liquid that may result from rough travelling conditions that may break or open a liquid containing toiletry item. The bag also has a resealable opening that is folded twice upon itself and secured in this folded position to maximize the retention of the liquid inside the bag.

In accordance with one embodiment of the invention, a leak-proof enclosure is provided comprising: a first side; a second side attached to the first side to form a cavity therebetween, the second side having an opening for inserting items into the cavity and a top edge located adjacent the opening; resealable closure means for securing the opening in a sealed position to thereby seal the cavity; and resecurable flap means for sealingly supporting the opening being sealed by the closure means, the flap means having a flap attached to the first side of the enclosure for folding over said resealable closure means, a first resealable fastener and a second resealable fastener, the first resealable fastener including a first part disposed on the flap and facing the first side, and a second part disposed on the second side, the second resealable fastener including a first portion disposed on the first side and facing the flap, and a second portion disposed on the second side between the opening and the second part of the first resealable fastener, wherein to utilize the enclosure (a) the resealable closure means is first secured so as to seal the opening in the sealed position, (b) the enclosure is then folded upon itself at a first lateral fold located between the opening and the second portion of the second resealable fastener such that the top edge of the second side is positioned adjacent the second portion of the second resealable fastener, (c) the enclosure then folded again about a second lateral fold located between the first lateral fold and the second portion of the second resealable fastener such that the first and the second portions of the second resealable fastener mate and fasten, and (d) the flap then being secured such that the first and the second parts of the first resealable fastener mate and fasten to thereby fully secure said leak-proof enclosure. Preferably, the resealable closure means comprises a press-and-fit locking strip having two ends. Still more preferably, the leak-proof enclosure further comprises absorbing means disposed within the cavity for absorbing any free liquid contained therein. Advantageously, the resealable closure means further comprises a reinforcing safety flap located at each end of the press-and-fit locking strip for preventing damage to the resealable closure means in the event excessive force is applied in opening the resealable closure means, and the absorbing means comprises a polyether hydrophilic open-cell sponge for containing spills within the cavity and preventing spills from spreading.

In a preferred embodiment, two first side, the second side, and the flap comprise high-density and high-impact vinyl that is substantially puncture resistant, and the first and the second resealable fasteners comprise hook-and-loop fasteners. Advantageously, the second resealable fastener, when fastened, secures the first lateral fold so as to form a crimp that presses the first and the second sides together to thereby further prevent leakage of any free-liquid, and first resealable fastener, when fastened, further secures the crimp formed by the first lateral fold.

In accordance with another aspect of the invention, a method is provided for sealing a resealable leak-proof enclosure having a top end and comprising a front side and a back side that together define a cavity having an opening, a pair of cooperating resealable elements that border the opening, wherein the opening and the resealable elements are disposed adjacent the top end, a flap located on the back side, a first fastener having a first and a second part, and a second fastener having a first and a second portion, the first part being on the front side and located adjacent and below the resealable elements, the first portion being located adjacent and below the first part, the second part being located on the back side adjacent the top end, the second portion being located on the flap and facing the back side, the method comprising: sealing the opening by engaging the cooperating resealable elements; forming a first crimp in the enclosure below the top end; forming a second crimp below the first crimp; and utilizing the first fastener to secure the first crimp and the second crimp; utilizing said second fastener to further secure the first crimp and the second crimp as well as the first fastener to fully seal the resealable leak-proof enclosure.

Other features and advantages of the invention will be set forth in, or apparent from the following detailed description of the preferred embodiments of the invention.

DESCRIPTION OF THE PREFERRED EMBODIMENTS

Figure 1:
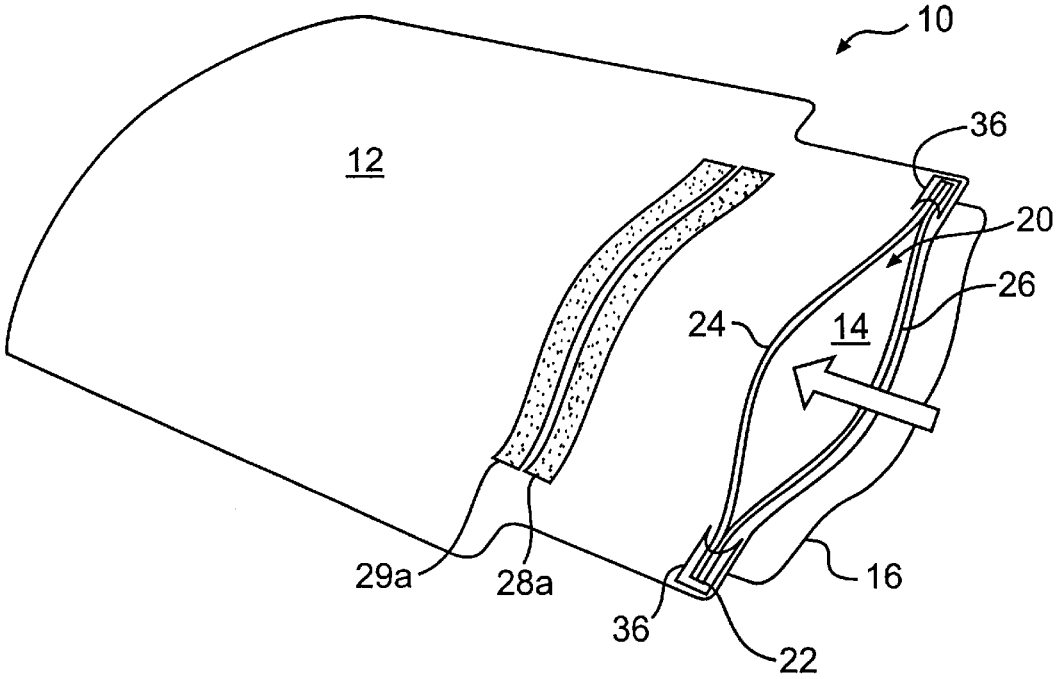
FIG. 1 is a front perspective view of a leak-proof enclosure of the invention in an open position.

Referring to FIG. 1, there is shown a perspective view of an enclosure or bag, generally denoted 10, that comprises a front side 12, a back side 14, and a flap 16. The sides 12, 14 and flap 16 are comprised of high-density, high-impact vinyl which is water-proof and virtually puncture-proof even under the most difficult of travel conditions.

Bag 10 has an opening 20, and surrounding opening 20 is a press-and-fit seal or closure means 22, shown as a ziplock closure, for securing the opening in a repeatedly resealable manner. Seal 22 comprises a pair of complementary resilient extruded plastic seal strips 24 and 26 having a separably interlockable profile which can be pressed together for closing seal 22, and pulled apart for opening seal 22. Seal 22 has a plastic safety catch 36 at both ends to prevent the seal 22 from tearing if excessive force is applied in the open position.

FIG. 1 also shows a pair of strips 28*a* and 29*a* that each form one part of one of a pair of fasteners 28 and 29 (FIG. 12) that are discussed in more detail below.

Figure 2:
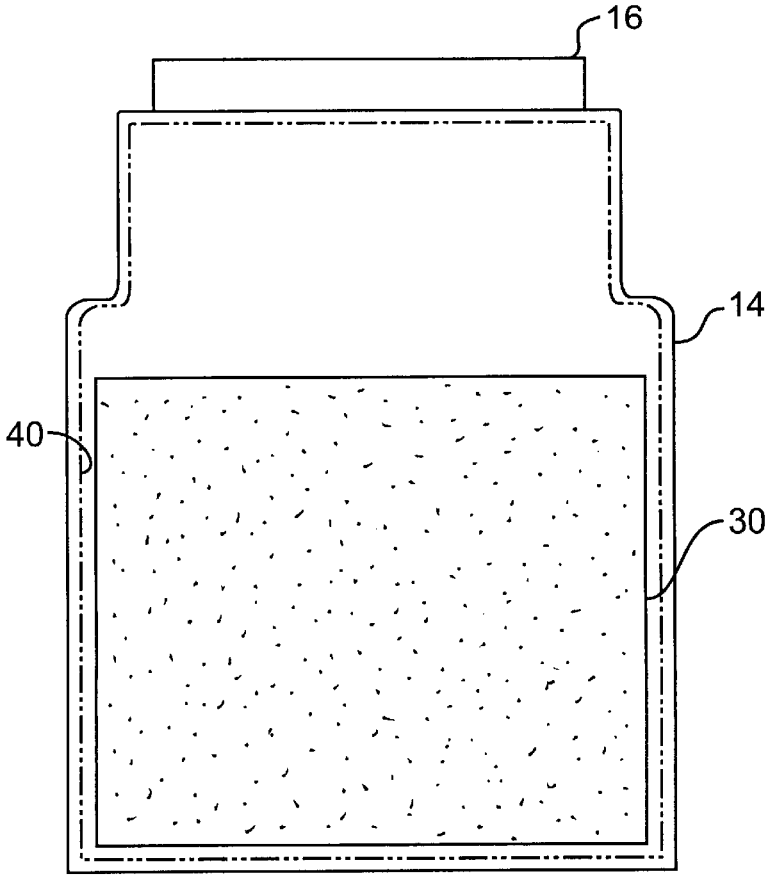
FIG. 2 is a front view with the front side removed and hence showing the inside portion of the back side of the invention.
Figure 5:
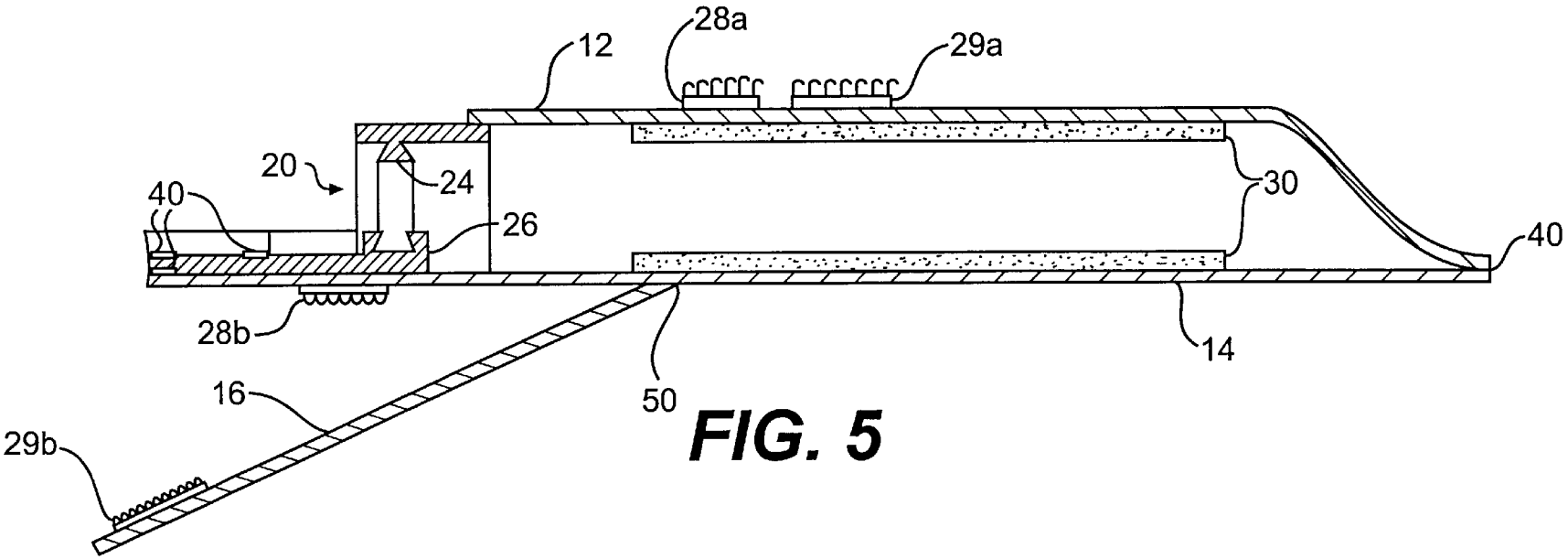
FIG. 5 is a side cross-sectional view of the invention taken along the line 5—5 in FIG. 3.
Figure 12:
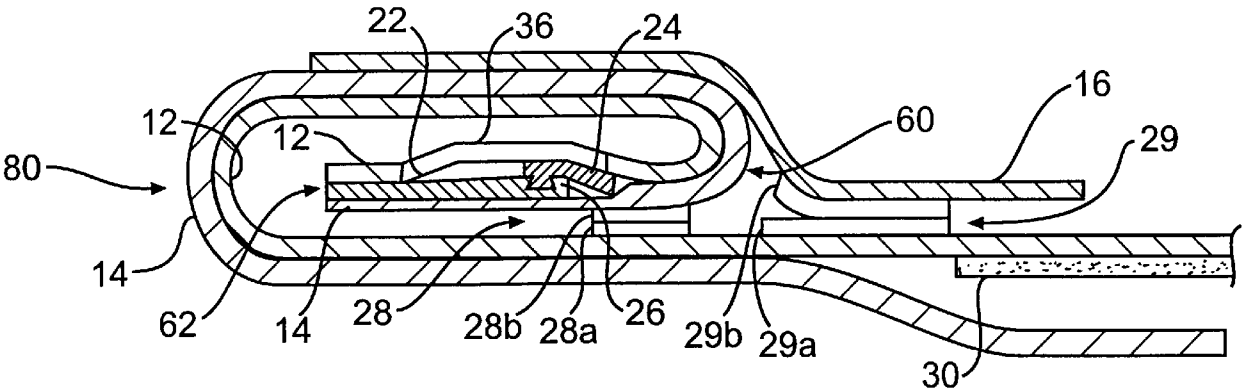
FIG. 12 is a enlarged side cross-sectional view of a portion of the closed bag shown in FIG. 11.

FIG. 2 illustrates the inside surface of back side 14 with front side 12 removed. FIG. 2 thus shows an optional absorbing membrane means 30 for soaking up spills of free liquid that occur inside bag 10. Absorbing membrane means 30 is comprised of a highly absorbent polyether-hydrophilic open-cell sponge placed on the interior of bag 10. FIG. 2 shows absorbing membrane means 30 as being disposed on back side 14. Alternatively, absorbing means 30 can be placed on front side 12 (as shown in FIG. 12), or on both front side 12 and back side 14 (as shown in FIG. 5). However, as noted above absorbing membrane 30 is optional, and need not be included at all.

Figure 3:
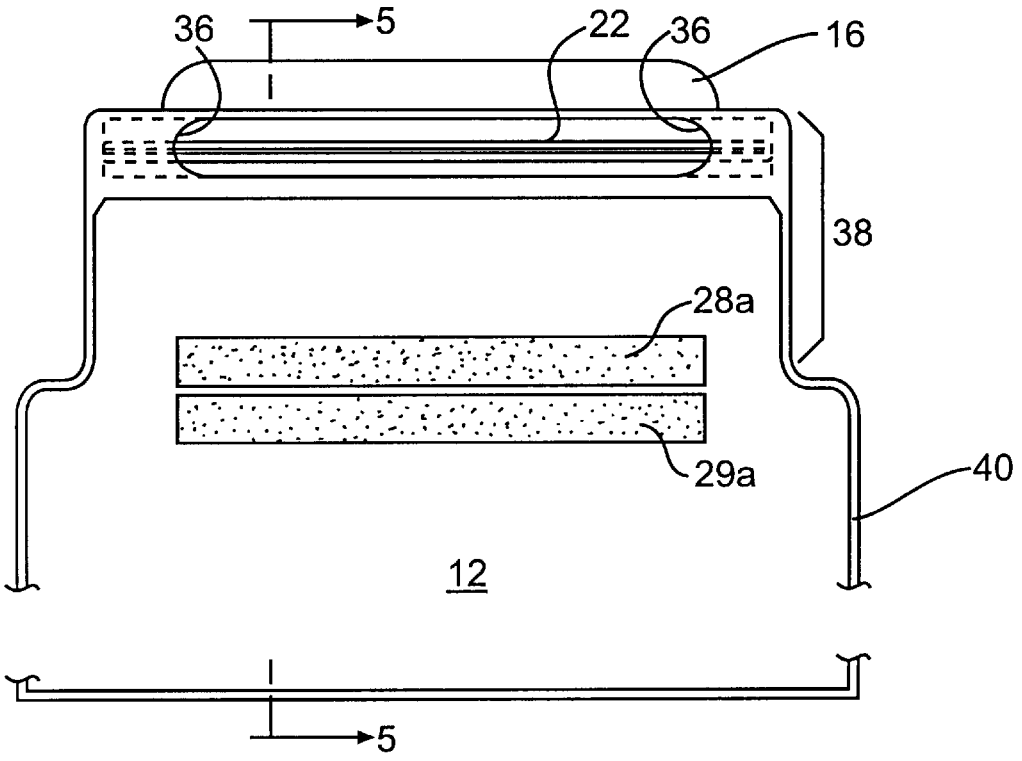
FIG. 3 is a front view of the top of the invention.

FIG. 3 illustrates an enlarged front view of bag 10 with seal 22 closed. Seal 22 is shown as a heavy duty ziplock type closure but could also be a ziplock with a slider, a normal zipper with teeth and a slider to open and close it, or any similar structure. Bag 10 also has a neck portion 38, adjacent to which bag 10 expands in width to better accommodate objects of the various size or objects positioned in various orientations. Front side 12 is attached to back side 14 by a heat seal 40, but many other well-known ways of establishing a permanent sealed bond exist. Heat seal 40 is depicted as surrounding the entire perimeter of bag 10, as well as for attached seal strips 24 and 26 to the inside of front side 12. Seal 22 is thus attached only to front side 12 and completely surrounds opening 20. Of course, heat seal 40 could attach less then the full perimeter of sides 12, 14 (shown here as being congruent) such that one of a pair of complementary strips 24, 26 are placed respectively on one of the sides 12, 14 to provide opening 20 at the most distal part of neck portion 38. FIG. 3 also depicts the position of strips 28*a* and 29*a* on front side 12 as discussed earlier in conjunction with FIG. 1.

Figure 4:
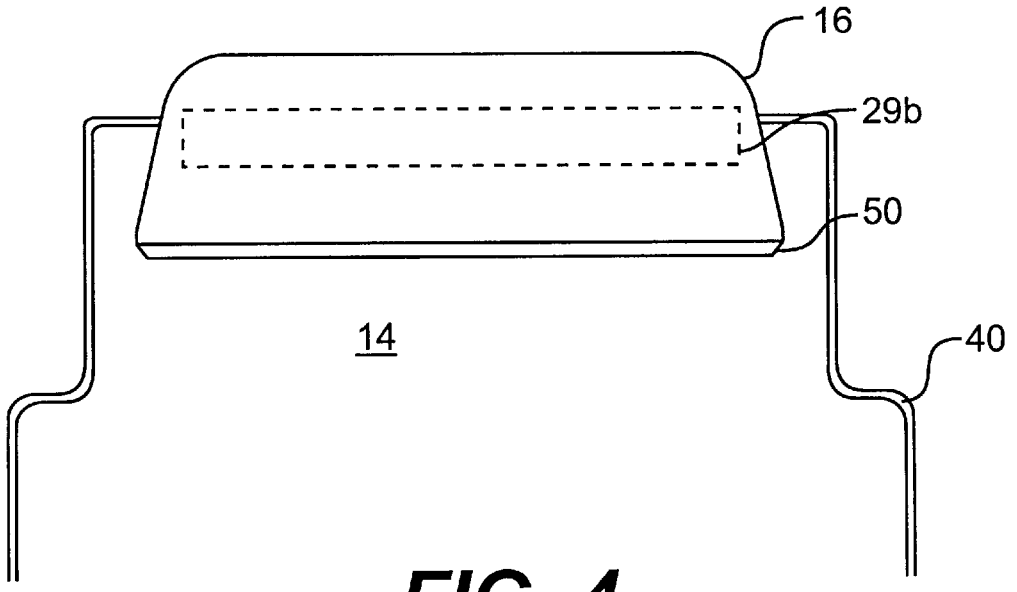
FIG. 4 is a back view of the top of the invention.

FIG. 4 illustrates the back view of bag 10 and better depicts flap 16. Flap 16 is shown as being attached to bag 10 by a heat seal 50, however, any method of attachment, such as by adhesives, would be satisfactory. A strip 29*b* is also shown in FIG. 4 in dashed lines as being disposed on the front side of flap 16. Strip 29*b* mates with strip 29*a* to form fastener 29 (FIG. 12).

FIG. 5 depicts a cross-sectional view of bag 10 as taken through the line 5—5 shown in FIG. 3. Complementary strips 24 and 26 of opening 20 are illustrated as being in an unlocked position so that items may be inserted into and removed from bag 10 through opening 20. FIG. 5 also shows strips 28*a* and 29*a* as being hooked elements that respectively mate with a pair of strips 28*b* and 29*b* which are looped elements. Strips 28*a*, 28*b*, 29*a* and 29*b* are attached by adhesives, although any conventional means for attachment is satisfactory. Once mated, strips 28*a* and 28*b* form resealable hook-and-loop fastener 28. Strip 29*a*, once mated with strip 29*b* forms resealable hook-and-loop fastener 29 as shown in FIG. 12 and described below in conjunction with FIGS. 6–11.

Figure 6:
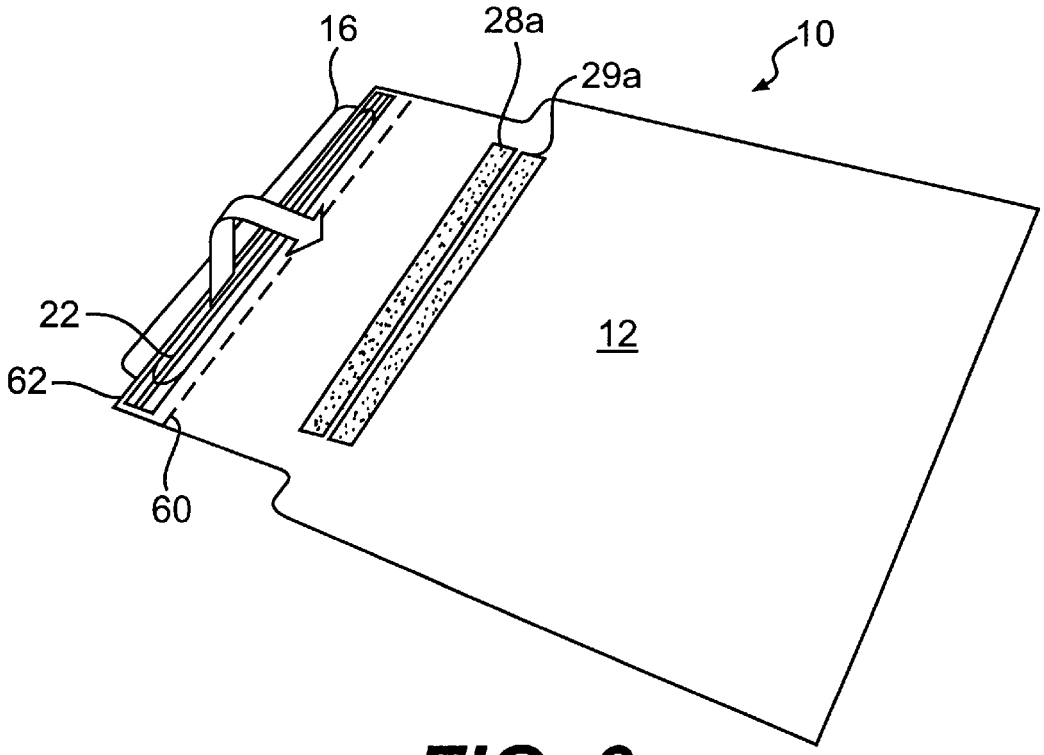
FIGS. 6–11 are perspective views sequentially showing the closure operation of the invention.
Figure 7:
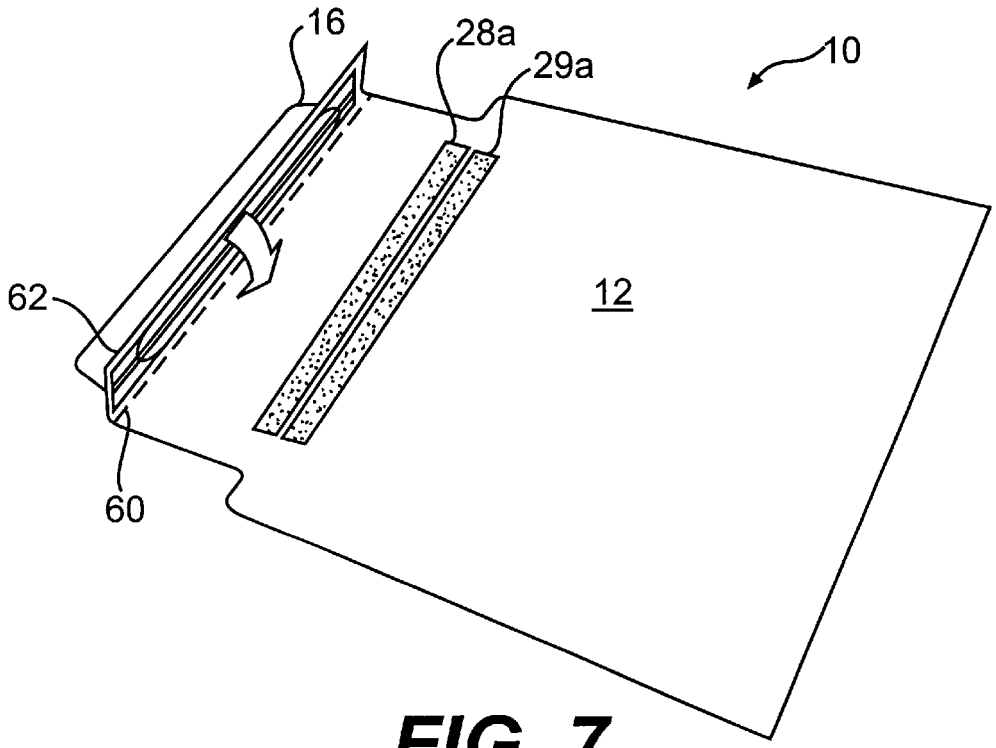

Referring now to FIGS. 6–11 which depict bag 10 in various stages of the closure process used to seal bag 10, opening 20 is initially closed to form seal 22 by engaging the complementary strips 24 and 26 as shown in FIG. 6. Next, FIGS. 6 and 7 utilize a wide arrow to illustrate the folding of bag 10 about a first lateral line 60 that is located between seal 22 and strip 28*a* so that a top edge 62 of bag 10 is positioned adjacent strip 28*a* (See FIG. 8). This forces sides 12 and 14 to be folded over or crimped together along lateral line 60 and exposes strips 28*b* and 29*b*. The crimped position along lateral line 60 establishes a second barrier in addition to seal 22 to prevent any free liquid that is not contained within absorbing membrane 30 from escaping bag 10.

Figure 8:
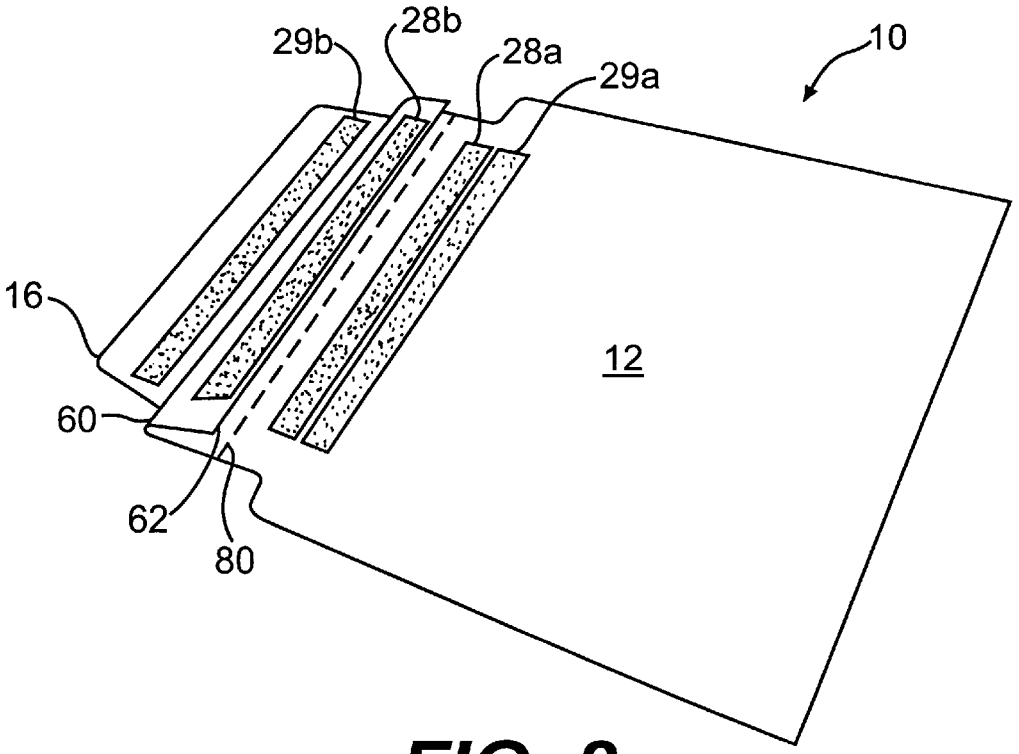
Figure 9:
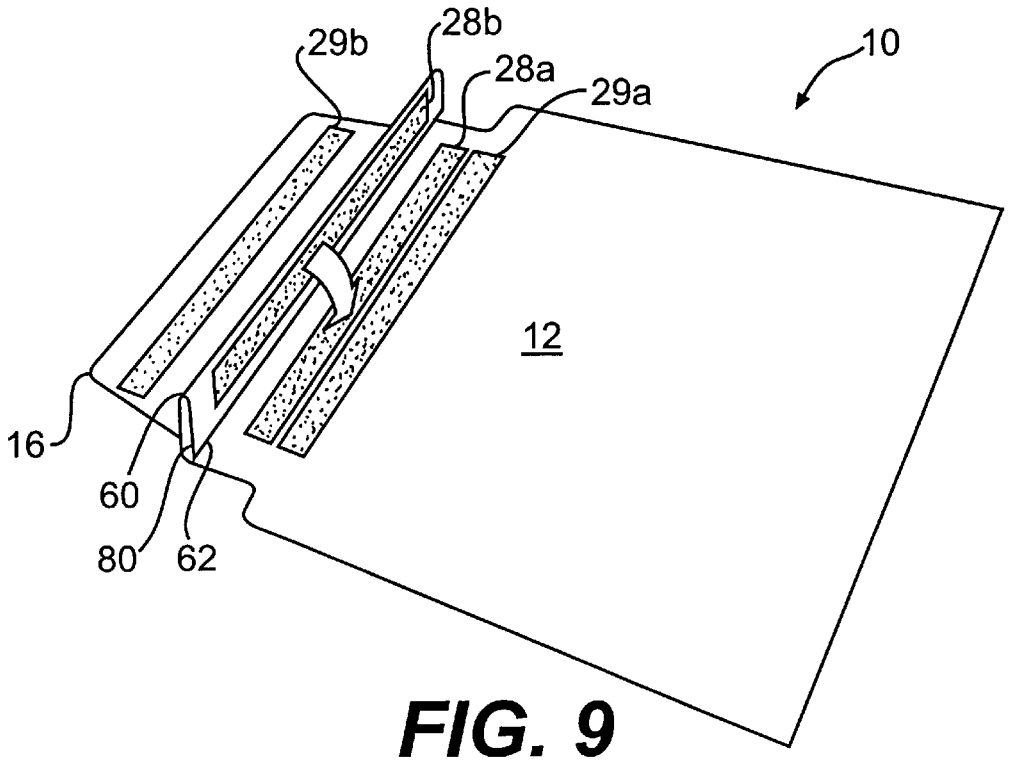
Figure 10:
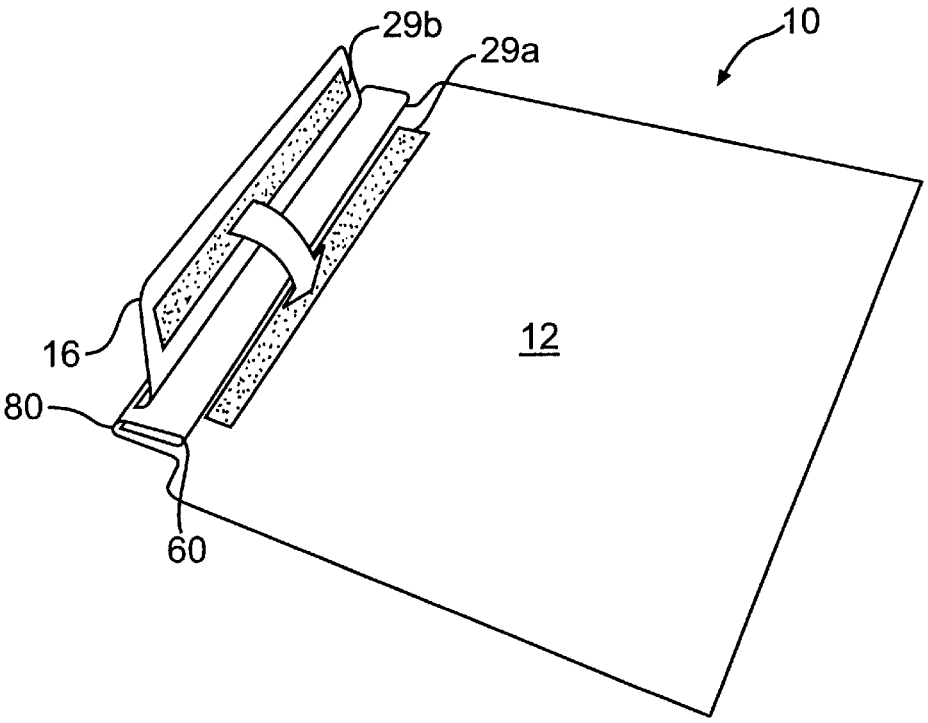

FIG. 8 shows the completed positioning of bag 10 after folding bag 10 about lateral line 60. After the fold along lateral line 60 is formed, bag 10 is folded again about a second lateral line 80 as illustrated in FIGS. 9–10, so that strip 28*b* is mated with strip 28*a* to form fastener 28 (FIG. 12). This folding along line 80 forces sides 12 and 14 to be crimped again together along lateral line 80 to provide a third barrier. When sides 12 and 14 are crimped together along lateral lines 60 and 80, a more secure seal is established to completely prevent the leakage of any free liquid not absorbed by membrane 30, and not contained by seal 22 or fold 60. Fastener 28 thus serves to lock sides 12 and 14 in the folded position along lines 60 and 80.

Figure 11:
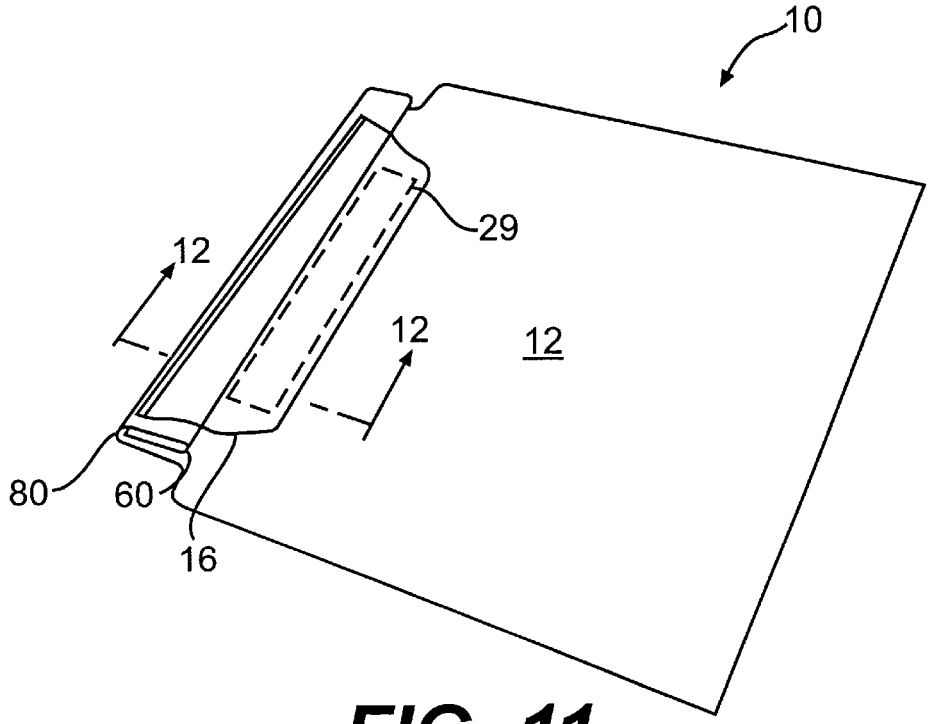

FIG. 10 further illustrates with another wide arrow that flap 16 is then folded onto side 12 so that strip 29*b* is mated with strip 29*a*, as shown in FIG. 11, to form fastener 29. This further ensures both lateral folds 60 and 80 remain in the crimped position to retain any free liquid and that fastener 28 remains fastened. FIG. 11 depicts bag 10 in the final sealed position.

FIG. 12 is an enlarged cross-sectional view of bag 10 taken along line 12—12 of FIG. 11. FIG. 12 shows only one absorbing membrane means 30 disposed on the inside of side 12, whereas the embodiment shown in FIG. 5 depicts two absorbing membrane means 30 disposed on both side 12 and side 14.

Although the present invention has been described with respect to specific exemplary embodiments thereof, it will be understood by those skilled in the art that variations and modifications can be effected in these exemplary embodiments without departing from the scope and spirit of the invention.

What is claimed is:

1. A leak-proof enclosure comprising:

a first side;

a second side attached to said first side to form a cavity therebetween, said second side having an opening for inserting items into said cavity and a top edge located adjacent said opening;

resealable closure means for securing said opening in a sealed position to thereby seal said cavity; and resecurable flap means for sealingly supporting said opening being sealed by said closure means, said flap means having a flap attached to said first side of said enclosure for folding over said resealable closure means, a first resealable fastener and a second resealable fastener, said first resealable fastener including a first part disposed on said flap and facing said first side, and a second part disposed on said second side, said second resealable fastener including a first portion disposed on said first side and facing said flap, and a second portion disposed on said second side between said opening and said second part of said first resealable fastener, wherein to utilize said enclosure (a) said resealable closure means is first secured so as to seal said opening in said sealed position, (b) said enclosure is then folded upon itself at a first lateral fold located between said opening and said second portion of said second resealable fastener such that said top edge of said second side is positioned adjacent said second portion of said second resealable fastener, (c) said enclosure then folded again about a second lateral fold located between said first lateral fold and said second portion of said second resealable fastener such that said first and said second portions of said second resealable fastener mate and fasten, and (d) said flap then being secured such that said first and said second parts of said first resealable fastener mate and fasten to thereby fully secure said leak-proof enclosure.

2. A leak-proof enclosure as claimed in claim 1 wherein said resealable closure means comprises a press-and-fit locking strip having two ends.

3. A leak-proof enclosure as claimed in claim 2 wherein said resealable closure means further comprises a reinforcing safety flap located at each end of said press-and-fit locking strip for preventing damage to said resealable closure means in the event excessive force is applied in opening said resealable closure means.

4. A leak-proof enclosure as claimed in claim 1 further comprising absorbing means disposed within said cavity for absorbing any free liquid contained therein.

5. A leak-proof enclosure as claimed in claim 4 wherein said absorbing means comprises a polyether hydrophilic open-cell sponge for containing spills within said cavity and preventing spills from spreading.

6. A leak-proof enclosure as claimed in claim 1 wherein said first side, said second side, and said flap comprise high-density and high-impact vinyl that is substantially puncture resistant.

7. A leak-proof enclosure as claimed in claim 1 wherein said first and said second resealable fasteners comprise hook-and-loop fasteners.

8. A leak-proof enclosure as claimed in claim 1 wherein said second resealable fastener, when fastened, secures the first lateral fold so as to form a crimp that presses said first and said second sides together to thereby further prevent leakage of any free liquid.

9. A leak-proof enclosure as claimed in claim 8 wherein said first resealable fastener, when fastened, further secures the crimp formed by the first lateral fold.

10. A method of sealing a resealable leak-proof enclosure having a top end and comprising a front side and a back side that together define a cavity having an opening, a pair of cooperating resealable elements that border said opening, wherein said opening and said resealable elements are disposed adjacent said top end, a flap located on said back side, a first fastener having a first part and a second part, and a second fastener having a first portion and a second portion, said first part being on said front side and located adjacent and below said resealable elements, said first portion being located adjacent and below said first part, said second part being located on said back side adjacent said top end, said second portion being located on said flap and facing said back side, said method comprising:

sealing said opening by engaging said cooperating resealable elements;

forming a first crimp in said enclosure below said top end;

forming a second crimp below said first crimp; and utilizing said first fastener to secure said first crimp and said second crimp;

utilizing said second fastener to further secure said first crimp and said second crimp as well as said first fastener to fully seal said resealable leak-proof enclosure.

* * * * *